US006669199B2

(12) United States Patent
Vesco

(10) Patent No.: US 6,669,199 B2
(45) Date of Patent: Dec. 30, 2003

(54) PLAYING CARDS COMPRISING NO AXIS OF SYMMETRY

(75) Inventor: Thierry Vesco, Decines (FR)

(73) Assignee: Systeme Creation Pratique SARL, Decines (FR)

( * ) Notice: Subject to any disclaimer, the term of this patent is extended or adjusted under 35 U.S.C. 154(b) by 0 days.

(21) Appl. No.: 10/192,295

(22) Filed: Jul. 10, 2002

(65) Prior Publication Data

US 2002/0171200 A1 Nov. 21, 2002

Related U.S. Application Data

(63) Continuation of application No. PCT/FR01/00255, filed on Jan. 26, 2001.

(51) Int. Cl.[7] ..... A63F 1/00

(52) U.S. Cl. ..... 273/294; 273/293; D21/376; D21/378

(58) Field of Search ..... 273/294, 293; D21/376–384

(56) References Cited

U.S. PATENT DOCUMENTS

| | | | | | |
|---|---|---|---|---|---|
| D126,404 S | * | 4/1941 | Nussgruber | ..... | D21/378 |
| 3,731,936 A | | 5/1973 | Copeland | ..... | 273/149 P |
| 5,490,676 A | * | 2/1996 | Rake et al. | ..... | 273/274 |
| D380,785 S | * | 7/1997 | Francis | ..... | D21/51 |
| D475,095 S | * | 5/2003 | Manville | ..... | D21/484 |

FOREIGN PATENT DOCUMENTS

| | | | | |
|---|---|---|---|---|
| DE | 299 09 916 U 1 | | 9/1999 | |
| FR | 814 212 | | 6/1937 | |
| FR | 2444479 A | | 7/1980 | |
| GB | 23073 | * | 10/1909 | ..... 273/294 |
| GB | 519336 | | 3/1940 | |

OTHER PUBLICATIONS

"Crooked Playing Card Deck", U.S. Games Systems, Inc. Catalog No. 38, p. 31, 1995.*

* cited by examiner

*Primary Examiner*—Benjamin H. Layno
(74) *Attorney, Agent, or Firm*—Heslin Rothenberg Farley & Mesiti P.C.

(57) ABSTRACT

A playing card device includes cardboard or plastic cards having a graphic design or a color on one of their faces which is repeated on the other cards. Each card includes a head that is globally circular or polygonal in shape and extended by a comma-shaped part such that the card has no axis of symmetry. The opposite faces of the cards include playing zones reserved for one or several particular figures of a specific game rule.

6 Claims, 2 Drawing Sheets

PLAYING CARDS COMPRISING NO AXIS OF SYMMETRY

CROSS-REFERENCE TO RELATED APPLICATIONS

This application is a continuation of PCT application PCT/FR01/00255, filed Jan. 26, 2001, designating the United States, and published in French as PCT WO 01/54778 on Aug. 2, 2001. PCT application PCT/FR01/00255 claimed the priority of French application FR 00.01069, filed Jan. 27, 2000. The entire disclosures of both these applications are incorporated herein by reference.

The subject of the present invention is a set of playing cards.

BACKGROUND OF THE INVENTION

Currently, playing cards in a specific set generally take the form of a small, rectangular piece of cardboard which on one of its faces includes a figure which is specific to the game, whilst the other face includes a graphic design or a colour which is repeated on all the other cards such that it is impossible to distinguish them from one another by observing said faces. During the game, the cards are held in a hand of playing cards, being superposed on one another and slightly offset so as to reveal a significant figure of the card.

The subject of document FR 814 212 is a playing card, the contour of which is oviform, with a single, longitudinal axis of symmetry.

SUMMARY OF THE INVENTION

The object of the present invention is to propose a set of playing cards that is more suitable for holding in one's hand and that allows users to set them up more easily and more rapidly than is the case with the cards described previously.

The set of playing cards according to the present invention is of the type comprising cardboard or plastic cards and is essentially characterized in that, on the one hand, each card consists of a head that is globally circular or polygonal in shape, being extended by a comma-shaped part such that said card comprises no axis of symmetry.

According to the invention, the comma-shaped part extending the head may include curved or straight edges.

In a preferred embodiment of the set of cards according to the present invention, the head has a globally circular shape and the lateral edges of the comma-shaped part are curved and bent such that one of said lateral edges is bent towards the inside and the other lateral edge is bent towards the outside, whilst the edge of the free end of the comma-shaped extension will preferably be rounded.

Moreover, to enable users, using one and the same set of cards, to play a number of educational and/or play-based games with different rules, the face opposite that which includes a graphic design or a colour may advantageously include, for a specific game rule, one or more playing zones reserved for one or more particular figures of a specific game rule.

The playing zones may be delimited by curved lines which will advantageously be in different colours in order better to distinguish said zones and thus the figures belonging to a specific game rule.

The head and the comma-shaped extension of a playing card according to the invention may each include playing zones located laterally so as to be visible in a hand of playing cards in a particular orientation of the card—vertical or horizontal—and according to a particular orientation of said head or, furthermore, according to the manner of superposing the cards in said hand.

Thus, the user will orient the cards in his hand in a certain way and/or will superpose them from left to right or from right to left on the basis of the rule of the game he has chosen.

The advantages and characteristics of the present invention will become more clearly apparent from the following description which relates to the appended drawing which shows a non-limiting embodiment of the invention.

DETAILED DESCRIPTION OF THE PREFERRED EMBODIMENTS

Figure 1:
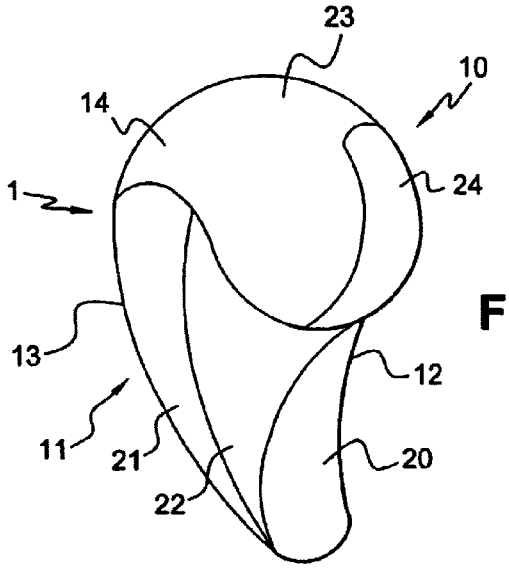
FIG. 1 shows a plan view of a playing card according to the invention in an embodiment which includes playing zones delimited by curved lines.

If reference is made to FIG. 1, it may be seen that a playing card 1 of a set of cards according to the invention consists in a preferred embodiment of a sheet of cardboard or PVC plastic cut so as to form a head 10 that is globally circular and extended substantially in the region of its half-circumference by a comma-shaped part 11 and whose free end is rounded.

The lateral edges 12, 13 of the comma-shaped part 11 are curved and bent such that one of the edges 12 is made concave and the other edge side 13 is made convex, this being so as to make the card asymmetrical.

The playing cards according to the present invention thus make it possible, on account of their asymmetry and their shape, for the user to set them up rapidly, easily identifying those which are oriented wrongly and those which are turned round.

Figure 3A:
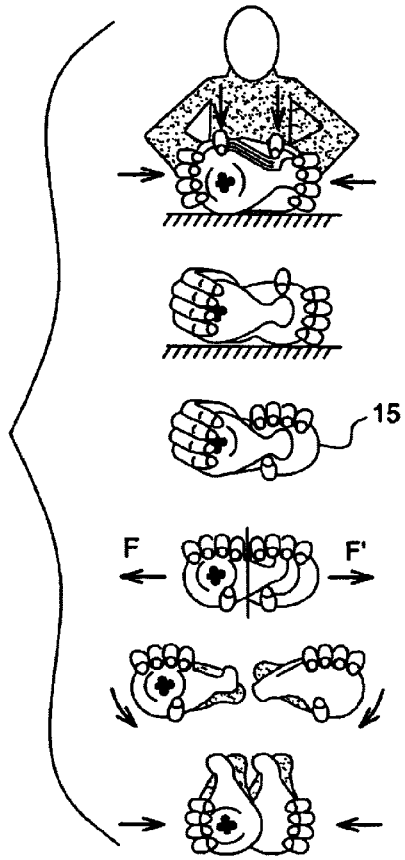
FIG. 3*a* shows the various stages in the process of setting up the cards according to the invention with a view to orienting them in the same direction.

FIG. 3*a* shows the operations to be carried out in order to orient all the cards in the same direction by grouping them together and then separating the cards 1 which are oriented differently by distancing them from one another in the directions F, F'.

Figure 3B:
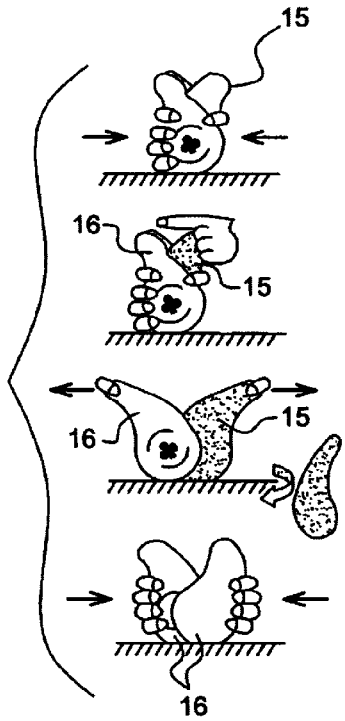
FIG. 3*b* shows the various stages in the process of setting up the playing cards according to the present invention, making it possible to turn the cards round such that they all have the playing face on the same side.

FIG. 3*b* shows how to separate the cards 15 which are turned round relative to the cards 16 by exerting a pressure in the direction P centrally on each side of the pack of cards 1, for example using a forefinger, separating the cards 15 which are turned round by moving said forefinger between the cards 15 and the other cards 16 from the free end of the comma-shaped part towards the other, opposite end.

Figure 4:
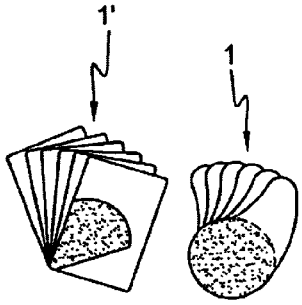
FIG. 4 shows a current playing-card hand and a playing-card hand according to the present invention.

Finally, it may be seen in FIG. 4 that the cards 1 according to the present invention, for one and the same number of cards, make it possible, compared with conventional rectangular cards, to achieve less volume in a hand and greater holding surface 17.

The face 14 of the card 1, which is intended to include the figures of the signs of games with different rules, will preferably be that face where, when the card 1 is oriented with its head 10 upwards, as is the case in FIG. 1, the concave lateral edge 12 is the lateral side located to the right and the convex lateral edge 13 is the lateral side located to the left.

It is also possible to see in FIG. 1 that the face 14 of the card 1 thus oriented is advantageously divided into five zones 20, 21, 22, 23, 24 which are delimited by curved lines 2, one 2' of which is transverse, substantially separating the head 10 from the comma-shaped part 11.

It may be seen that the curved lines 2 reveal, on the one hand on the comma-shaped part, two zones 20, 21 each extending respectively along one 12, 11 of its lateral edges and, on the other hand, on the head 10, a zone 23 occupying a large part of the surface of said head and a lateral zone 24 located on the right side. The zone 20 which extends along the right lateral edge 12 converges from the free end of the comma 11 to the transverse line 2' and the zone 21 extends along the left lateral edge 11, converging from the transverse line 2' to the rounded free end of the comma formed by the end of the zone 20.

Each zone 20, 21, 22, 23 or 24 is intended to include a figure or words with letters of the alphabet or Braille letters, for example. The zones 20, 21 and 24 allow the figures or the words to be seen clearly when the cards from a hand of playing cards, as may be seen in FIGS. 2*a* to 2*c*.

Figure 2A:
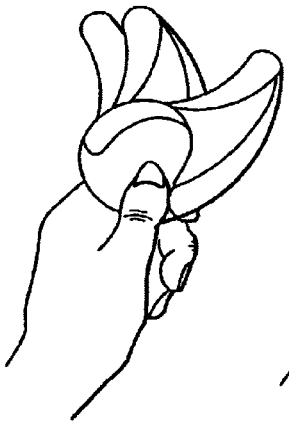
FIG. 2*a* shows a plan view of a hand of three cards which are oriented vertically head downwards.
Figure 2B:
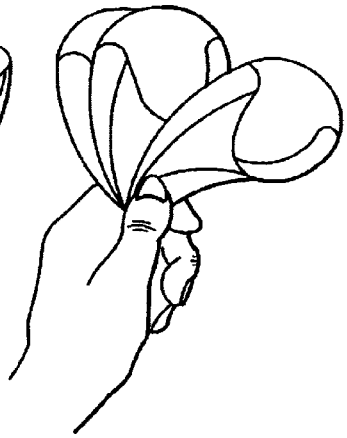
FIG. 2*b* shows a plan view of a hand of three cards oriented vertically head upwards and offset towards the right.
Figure 2C:
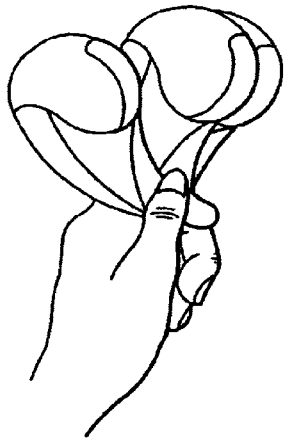
FIG. 2*c* shows a plan view of a hand of three cards which are oriented as in FIG. 2*b*, but offset towards the left.
Figure 2D:
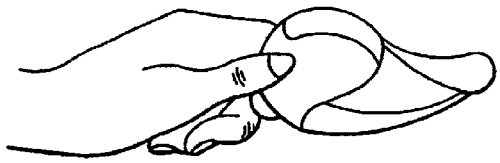
FIG. 2*d* shows a plan view of a card oriented horizontally.

Thus, as may be seen in FIGS. 2*a* to 2*d*, the cards are oriented in a certain manner, vertically (FIGS. 2*a* to 2*c*) or horizontally (FIG. 2*d*), or are superposed by being offset towards the right (FIG. 2*b*) or offset towards the left (FIG. 2*c*) depending on the game rule selected, revealing the corresponding playing zone, for example zone 20 in FIG. 2*a*, zone 21 in FIG. 2*b* and zone 24 in FIG. 2*c*.

It will be noted that the cards may include either a face with a graphic design or a colour which is repeated on all the other cards and one playing face or two playing faces without departing from the scope of the invention.

What is claimed is:

1. A playing card device comprising a plurality of at least one of cardboard and plastic cards, each card comprising a head portion that is at least one of globally circular and polygonal in shape, and a comma-shaped portion extending from said head portion such that said card comprises no axis of symmetry for rapid and proper orientation of each of said cards when said cards are collected and stacked in one deck.

2. The device of claim 1 wherein said head comprises portion a circular shape and lateral edges of said comma-shaped portion are curved and bent such that one of said lateral edges is bent inwards and another of said lateral edges is bent outwards, and an edge of a free end of said comma-shaped part is rounded.

3. The device of claim 2 wherein a face of each of said cards comprises at least one of a graphic design and a color, and an opposite face comprises playing zones reserved for at least one figure of a specific game rule.

4. The device of claim 3 wherein said playing zones are delimited by curved lines.

5. The device of claim 1 wherein a face of each of said cards comprises at least one of a graphic design and a color, and an opposite face comprises playing zones reserved for at least one figure of a specific game rule.

6. The device of claim 5 wherein said playing zones are delimited by curved lines.

* * * * *